United States Patent [19]

Bagnall

[11] Patent Number: 4,870,915

[45] Date of Patent: Oct. 3, 1989

[54] YARN FEED SYSTEM FOR TUFTING MACHINES

[75] Inventor: Arthur F. Bagnall, Manchester, England

[73] Assignee: Spencer Wright Industries, Inc., Dalton, Ga.

[21] Appl. No.: 315,322

[22] Filed: Feb. 24, 1989

[30] Foreign Application Priority Data

Mar. 2, 1988 [GB] United Kingdom ..... 8804927

[51] Int. Cl.[4] ..... D05C 15/30

[52] U.S. Cl. ..... 112/80.41; 112/80.73

[58] Field of Search ..... 112/80.73, 80.41

[56] References Cited

U.S. PATENT DOCUMENTS 3,955,514 5/1976 Prichard ..... 112/80.73

4,411,207 10/1983 Brock et al. ..... 112/80.73

*Primary Examiner*—Ronald Feldbaum

*Attorney, Agent, or Firm*—Alan Ruderman

[57] ABSTRACT

A tufting machine having laterally shifting needles has a controlled amount of yarn fed to the needles, the amount of yarn being appropriate for the insertion of a diagonal back stitch such as arises during lateral shift of the needles relative to a backing material during the tufting operation. The yarn is wrapped about a plurality of rotating feed rollers each driven at a constant speed, the rollers having a smooth surface so that the yarn slips on the rollers until the needles induce sufficient tension on the yarn to cause it to grip and be driven by the rollers. The speed of the rollers is greater than the required to accommodate the yarn requirements of the needles if no slippage occurred between the yarn and the rollers. An additive tension may be applied between the feed rollers and the needles by a leaf spring and an anvil against which the leaf spring is biased, the yarn being fed between the anvil and the spring.

14 Claims, 1 Drawing Sheet

YARN FEED SYSTEM FOR TUFTING MACHINES

BACKGROUND OF THE INVENTION

This invention concerns tufting machines, and more particularly to the feeding of yarn to the needles of such machines.

In the manufacture of tufted fabrics by a tufting machine having a multiplicity of reciprocable needles and a corresponding multiplicity of hooks or loopers selectively cooperable with respective ones of the needles, the needles and hooks or loopers being provided on opposite sides of a backing fabric and the needles penetrating the backing material to cooperate with respective hooks or loopers in forming loops at the reverse of such fabric, it is known to shift the needles laterally for patterning or other purposes, the needles, in such circumstances, moving to a position for cooperation with a different respective hook or looper from those with which the needles previously cooperated.

In the absence of lateral needle shift, each needle introduces a line of tufts which extends in the longitudinal direction of the backing material, the back stitch which exists at the needle side of the backing material between successive needle penetrations, and thus between successive yarn tufts, defining a sensible continuous straight line parallel to the direction of fabric movement.

If a lateral shift of the needle occurs between successive needle penetrations, the resultant back stitch will be of a zig-zag form and the back stitch extends in a direction which is diagonally inclined to the direction of fabric movement, and since the rate of advance of the backing fabric remains constant, the length of the individual back stitch will be increased accordingly. Thus, a greater length of yarn is required to form a fixed pile height loop. If the rate of yarn fed for that machine cycle is not increased, the yarn will be back robbed or withdrawn from the previously formed loop.

The yarn feed system of a tufting machine is traditionally by means of constant feed rate rollers wherein equal angles of rotation of a machine mainshaft produce equal angles of rotation of the yarn feed rollers. The rollers have a relatively high friction surface of rubber or the like, or a roughened or gritty material, such as sandpaper or the like, and the yarn is trained about the rollers and positively fed at a constant rate. The feed rate is sufficient to provide a loop for seizure by the hook or looper and to provide the back stitch between successive loops, and if there is a shortage of yarn for seizure by the needle, the yarn is back robbed from the previous stitch.

Such a direct drive feed roller system can not accommodate the changes in yarn feed requirement arising from lateral needle shift and gives rise to an uneveness in the pile height which detracts from the appearance of the fabric. In the case of cut pile fabrics, excessive shearing of the surface to level the pile height is required. A further consequence is that, due to varying yarn tension, difficulty may be experienced in attaining accurate alignment between the needle and the hook or looper and satisfactory loop seizure.

SUMMARY OF THE INVENTION

Consequently, it is a primary object of the present invention to provide a tufting machine wherein the adverse effects of changed yarn requirements arising from lateral needle shift are reduced or eliminated.

It is another object of the present invention to provide tufting machine yarn feed apparatus having at least one constantly rotating smooth surface feed roller about which yarn is wrapped and which drives the yarn when tension is induced on the yarn by the needle, the amount of feed being dependent upon the amount of movement of the needle.

It is a further object of the present invention to provide a method of feeding yarn to the tuft forming instrumentalities of a tufting machine by wrapping the yarn about at least one constantly driven feed roller and causing the yarn drivingly to engage the roller by tensioning the yarn downstream of the roller by needle movement.

Accordingly, the present invention provides in a tufting machine having laterally shiftable needles and a control mechanism adapted to effect such lateral shift according to a predetermined sequence a yarn feed arrangement operable to provide a variable rate of yarn feed adapted to accommodate changes in yarn requirements arising from lateral needle shift. Thus, changes in yarn feed rate will be made accordingly to the lateral shift of the needles, the yarn feed being controlled by the needles and corresponding to the patterning sequence which gives rise to a straight or a diagonal back stitch. Consequently, the amount of yarn fed during each stitch accommodates the yarn requirements needed by the needle stitching system and back robbing from prior stitches is eliminated.

In carrying out the present invention, each yarn strand is trained or wrapped about at least one smooth surfaced feed roller driven at a constant speed, and the yarn is tensioned by the movement of the respective needle downstream of the roller to be brought into driving relationship with the roller. The needle-movement induced tensioning controls the tension on the yarn and the tighter the yarn is drawn against and grips the roller, the greater the yarn feed rate. When there is no tensioning of the yarn, the yarn merely slips on the smooth roller surface. The slippage is controlled by the tension of the yarn as provided by the needle, and this is directly related to the yarn required by the needle so that the yarn fed by the roller accommodates the needle system requirements. Since the yarn is wrapped about at least one constantly rotating feed roller a multiplicative tension reduction is provided to the yarn which is subjected to a subsequent additive tension adjustment by the needle.

Another preferred feature of the invention includes an additive tension means disposed intermediate the feed roller and the needle, this tension means being any convenient yarn tensioning device such as, for example, a leaf spring bearing against an anvil with the yarn passing in the nip therebetween.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
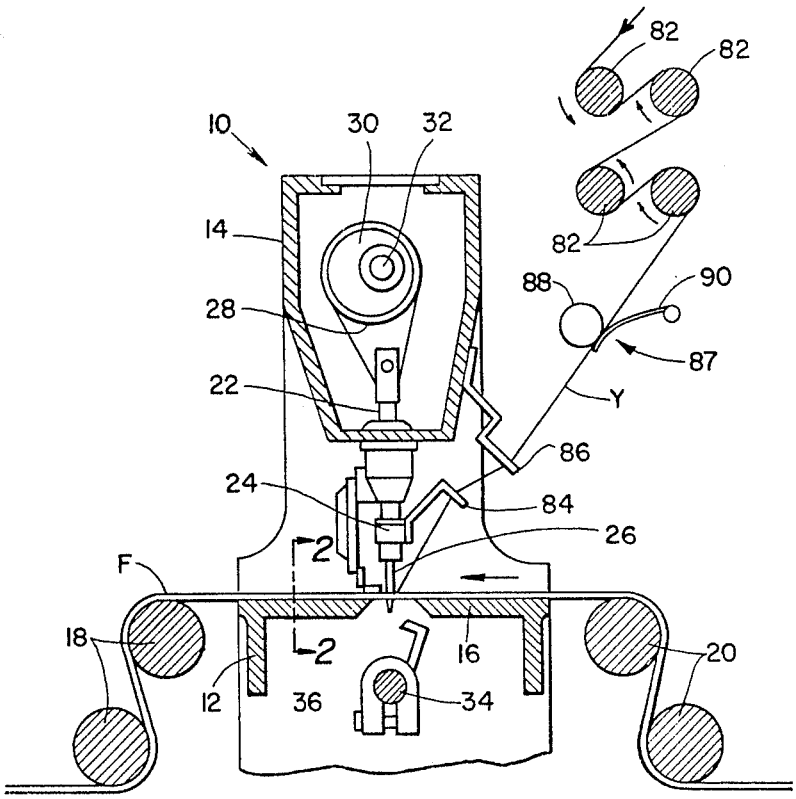
FIG. 1 is a diagrammatic transverse cross sectional view through a multi-needle tufting machine incorporating a yarn feed system constructed in accordance with the priciples of the present invention.
Figure 2:
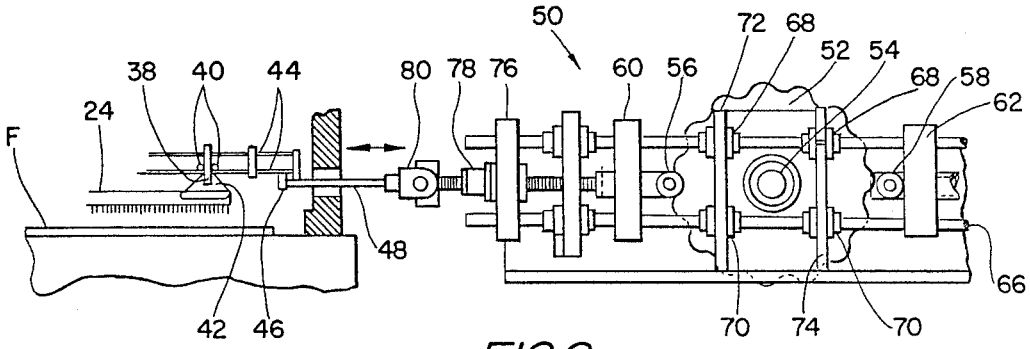
FIG. 2 is a fragmentary cross sectional view taken substantially along line 2—2 of FIG. 1.

Referring now to the drawings, there is illustrated in FIG. 1 a tufting machine 10 having a frame comprising a bed 12 and a head 14 disposed above the bed 12. The bed includes a base plate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried, the needle bar being mounted for lateral or transverse sliding movement relative to the direction of reciprocation of the push rods and transverse to the direction of feed of the fabric F. The needle bar 24 carries a plurality of needles 26 that are adapted to penetrate the fabric F on the bed plate 16 upon reciprocation of the needle bar 24 to project loops of yarn therethrough. End wise reciprocation is imparted to the push rods 22 and thus the needle bar 24 and needles 26 by, for example, a link 28 which is pivotably connected at its lower end to the push rods 22 and at its upper end to an eccentric 30 on a driven rotary mainshaft 32 journally mounted longitudinally in the head 14.

Journalled beneath the bed plate 16 is an oscillating hook or looper shaft 34 which is arranged parallel to the mainshaft 32 and which carries a plurality of hooks or loopers 36. Each hook or looper 36 cooperates with a respective needle 26, the particular needle cooperating with a particular hook or looper being determined upon the lateral or transverse position of the needle bar 24. While, to simplify the disclosure, only a single needle 26 and single hook or looper 36 is shown, it is understood that a multiplicity of such elements are provided laterally across the machine, and that the number may be upwards of 1,000 of such elements.

In order to drive the needle bar 24 selectively with controlled lateral movement, the needle bar 24 is provided with a number of upstanding plate members 38 (only one of which is illustrated) which are straddled by a pair of rollers 40 pivotably mounted on mounting plates 42 secured to brackets (not illustrated) clamped to a pair of laterally extending slide rods 44. The slide rods are journalled in brackets (not illustrated) fixed to the head 14 of the machine above the needle bar. At one end of the machine the slide rods 44 are fastened to a clamping block 46 above the bed. A drive rod 48 is secured to the clamping block 46 and extends through the housing of the tufting machine head 14 toward shifting apparatus generally indicated at 50, the drive rod 48 being journally mounted for sliding laterally relative to the direction of fabric feed The shifting apparatus 50 is fully disclosed in U.S. Pat. No. 4,465,001 assigned to the assignee of the present invention. Briefly, this shifting apparatus includes a cam 52 rotatably driven on a shaft 54 in timed relationship with the reciprocation of the push rods 22. The cam 52 acts in conjunction with a pair of followers 56, 58 supported by respective brackets 60, 62 secured to guide rods 64, 66 slidably journalled in respective linear bearings 68, 70 carried by brackets 72, 74. As the cam 52 rotates its motion is transmitted through the followers 56, 58 to the brackets 60, 62, and from these brackets to the guide rods 64, 66. A clamping block 76 is secured to the guide rods 64, 66 and has a collar or the like 78 connected thereto, the collar being attached in adjustable fashion through a connecting member 80 to the rod 48. Accordingly, as the cam 52 rotates the needle bar 24 is shifted laterally as determined by the pattern on the surface of the cam 52.

Yarn Y may be fed to the needles 26 by means of a plurality of yarn feed rollers 82 which may be mounted on or above the head 14 of the tufting machine 10. Yarn is received from a creel (not illustrated) and is wrapped or trained about the rollers 82 for feeding yarn through stationary guides 84, 86 to the needles 26. Conventionally, the feed rollers 82 have a roughened surface so as to drive the yarn positively, the speed of rotation of the rollers being fixed at such amount as to feed a required amount of yarn to the needles. However, as aforesaid, when the needles are shifted laterally by means of the shifting apparatus 50 the amount of yarn required to form the diagonal back stitch is greater than the amount of yarn required to form a straight stitch when no shifting occurs, and therefore, yarn is back robbed from the prior stitch and the pile height is uneven and detracts from the appearance of the fabric produced. When the needle reciprocates on a given axis, i.e., the needle bar is not shifted laterally, the yarn requirement at each needle cycle will remain constant, the amount of yarn being that necessary to provide a tuft of a pile height consistent with the needle stroke together with the amount of yarn extending at the surface of the backing fabric between successive needle insertions therethrough. However, when the needle bar is shifted laterally between successive needle insertions, the length of the resultant diagonal back stitch will exceed that of the straight back stitch according to the extent of needle shift.

In accordance with the present invention the feed system delivers yarn according to the stitch requirements by providing constantly rotating feed rollers 82 with relatively smooth surfaces so that the rollers slip within the wrap of yarn thereon except when the yarn is subjected to tension at the output side of the rollers due to downward or lateral movement of the needles. Preferably the surfaces of the yarn feed rollers 82 have a metallic surface, and matt chrome plated rollers have performed successfully. The rollers 82 are driven faster than required to accommodate the yarn requirements of the system since there is always some slippage between the yarn and the rollers. There is always tension on the input side of the yarn from the creel, but the tension on the output side to the needle is generally only such as to permit slipping between the rollers and the yarn except when the needles are driven downwardly to pull on the yarn and when the needles are shifted laterally just prior to downward movement during lateral shifting of the needle bar. Any increased length of yarn necessary to provide the diagonal back stitch due to the lateral needle shift is thus automatically provided for since the lateral needle shift itself tensions the yarn and thus effects the period of drive engagement of the yarn with the rollers, and thus the length of yarn supplied.

Accordingly, the yarn feed rollers act as capstans and serve to feed yarn according to the yarn requirement of the needle in penetrating the backing fabric F and providing the necessary back stitch arising from the advancing backing fabric F and, in the case of the sliding or shifting needle bar arrangement, any lateral shift of the needle relative to the backing fabric. While the feed means is described in the context of a single reciprocating needle, it is well known in the art, and it is to be appreciated that, in practice multiple yarns each delivered to a respective needle will be wrapped or trained about the plurality of feed rollers, and the yarn to each needle will be delivered according to the requirements of that needle.

The yarn feed system of the present invention may further include a tension device 87 positioned between the yarn feed rollers 82 and the fixed yarn guides 84, 86. The tension device may comprise an anvil 88 against which a leaf spring 90 resiliently bears, the yarn Y passing between the anvil 88 and the leaf spring 90 and being tensioned according to the loading applied by the leaf spring. Other tensioning devices may comprise two leaf springs acting together, or a long bar having grooves through which the yarn is fed and with a spring wire acting to trap the yarn in the grooves. It is significant to note that any such tensioning device acts to trap the yarn so as to apply an additional tension on the output side of the yarn feed rollers thereby to increase the tension of the yarn on the feed rollers so that the feed rollers apply a greater gripping action on the yarn to provide a more driving engagement therewith. The multiplicative tension effect in passing the individual yarns Y successively around a plurality of rollers 82 has the advantage of reducing, in numerical terms, any difference in the respective tensions at which yarns are drawn from the creel, and by introducing a predetermined additive tension by the tensioning means 87, proportionate tension differentials at the needle are minimized. While it is preferred that tension means 87 be provided intermediate the feed rollers and the needle, such additional tensioning means is unnecessary for the satisfactory practicing of the method of the present invention. Thus, in its broadest sense the invention contemplates a feed system wherein driving engagement with constantly rotating smooth surface feed rollers according to needle induced tensions. However, an additive tension device would appear to benefit the system. Additionally, it may be that benefit would stem from utilizing the relative movement between the fixed yarn guide 86 and the movable yarn guide 84, known in the art as a jerker bar, which moves with the needle bar on reciprocation thereof in tensioning the yarn for feed purposes at the top of the needle stroke.

The invention is not limited to the exact features of hte embodiment hereinbefore described. As an alternative to the partial wrapping of a yarn around each of a plurality of smooth rollers, multiple wraps of a yarn about a single roller may be preferred.

Numerous alterations of the structure herein disclosed will suggest themselves to those skilled in the art. However it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a multiplicity of needles, means for reciprocably driving said needles in a first path, means for laterally shifting said needles in a path transverse to said first path, a multiplity of loop seizing members cooperating with said needles for forming loops, and control means adapted to effect said lateral shifting in accordance with a predetermined sequence, yarn feed apparatus operable in synchronism with said needles and said control means for feeding yarn to a respective needle, said yard feed apparatus intermediate said needle and a yarn supply, said feed roller having a surface about which yarn is wrapped, said surface being relatively smooth such that slippage occurs between said yarn and said until the tension on the yarn intermediate the needle and the roller overcomes said slippage and the yarn is drivingly engaged by the roller and fed to said needle, said tension being induced by the reciprocation of said needle to provide a first tension and by the shifting of said needle laterally to provide an additional tension, whereby a variable rate of yarn is fed to said needle to accommodate changes in yarn requirements arising from lateral needle shift.

2. In a tufting machine as recited in claim 1, wherein said roller is driven at a higher speed than that required to accommodate the yarn requirements of the needle if no slippage occurred between said yarn and said roller.

3. In a tufting machine as recited in claim 1, wherein said yarn feed apparatus includes an additive tension means disposed intermediate said feed roller and said needle.

4. In a tufting machine as recited in claim 3, wherein said additive tension means comprises means for resiliently clamping said yarn.

5. In a tufting machine as recited in claim 3, wherein said roller is driven at a higher speed than that required to accommodate the yarn requirements of the needle if no slippage occurred between said yarn and said roller.

6. In a tufting machine as recited in claim 1, wherein said apparatus comprises a plurality of yarn feed rollers each having a smooth surface about which yarn is trapped in seriatim, each of said rollers being driven at a constant speed.

7. In a tufting machine as recited in claim 6, wherein each roller is driven at a higher speed than that required to accommodate the yarn requirements of the needle if no slippage occurred between said yarn and said rollers.

8. In a tufting machine as recited in claim 6, wherein said yarn feed apparatus includes an additive tension means disposed intermediate said feed roller and said needle.

9. In a tufting machine as recited in claim 8, wherein said additive tension means comprises means for resiliently clamping said yarn.

10. In a tufting machine as recited in claim 8, wherein said roller is driven at a higher speed than that required to accommodate the yarn requirements of the needle if no slippage occurred between said yarn and said roller.

11. A method of feeding yarn from a supply to a needle of a tufting machine comprising, wrapping a strand of yarn about at least one feed roller, rotatably driving said roller at a constant speed, said roller having a smooth surface so that slippage occurs between said strand and said roller, and inducing tension on said yarn by said needle to force said yarn to be drawn tighter against said roller so as to grip said roller and be driven thereby in proportion to the tension induced by said needle.

12. In the method recited in claim 11, wherein said roller is driven at a speed greater than that required to accommodate the yarn requirements of the needle if no slippage occurred between said yarn and said roller.

13. In the method recited in claim 11, including applying an additive tension to said yarn intermediate said roller and said needle.

14. In the method recited in claim 13, wherein said roller is driven at a speed greater than that required to accommodate the yarn requirements of the needle if no slippage occurred between said yarn and said roller.

* * * * *